US010590896B2

(12) United States Patent
Soriani

(10) Patent No.: US 10,590,896 B2
(45) Date of Patent: Mar. 17, 2020

(54) LONG INJECTOR FOR FUEL INJECTION INTO AN INTERNAL COMBUSTION ENGINE

(71) Applicant: Continental Automotive GmbH, Hannover (DE)

(72) Inventor: Matteo Soriani, Livomo (IT)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 0 days.

(21) Appl. No.: 16/064,653

(22) PCT Filed: Dec. 20, 2016

(86) PCT No.: PCT/EP2016/081858
§ 371 (c)(1),
(2) Date: Jun. 21, 2018

(87) PCT Pub. No.: WO2017/108749
PCT Pub. Date: Jun. 29, 2017

(65) Prior Publication Data

US 2018/0372042 A1 Dec. 27, 2018

(30) Foreign Application Priority Data

Dec. 21, 2015 (EP) ..... 15201777

(51) Int. Cl.
*F02M 61/14* (2006.01)
*F02M 51/00* (2006.01)
*F02M 69/46* (2006.01)

(52) U.S. Cl.
CPC ..... *F02M 51/005* (2013.01); *F02M 69/465* (2013.01); *F02M 2200/8023* (2013.01); *F02M 2200/853* (2013.01)

(58) Field of Classification Search
CPC ..... F02M 51/005; F02M 69/465; F02M 2200/8023; F02M 2200/853
(Continued)

(56) References Cited

U.S. PATENT DOCUMENTS

| | | | | |
|---|---|---|---|---|
| 4,959,027 | A | 9/1990 | Muzslay | 439/655 |
| 5,129,834 | A | 7/1992 | Cranford | 439/130 |
| 5,203,304 | A | 4/1993 | Hafner et al. | 123/456 |
| 5,209,204 | A | 5/1993 | Bodenhausen et al. | 123/470 |

(Continued)

FOREIGN PATENT DOCUMENTS

| | | | | |
|---|---|---|---|---|
| CN | 102740666 | A | 10/2012 | H05K 9/00 |
| CN | 104350270 | A | 2/2015 | F02M 51/02 |

(Continued)

OTHER PUBLICATIONS

Extended European Search Report, Application No. 15201777.8, 7 pages, dated Apr. 22, 2016.

(Continued)

*Primary Examiner* — Hai H Huynh
(74) *Attorney, Agent, or Firm* — Slayden Grubert Beard PLLC

(57) ABSTRACT

Various embodiments may include a long injector for fuel injection comprising: a base portion and an extension portion electrically connected to the base portion. An end of the extension portion may include an electrically conductive terminal with contact clips. The contact clips are spaced at a distance from each other or from a side wall of the electrically conductive terminal. An end of the base portion comprises electrical contacts positioned so each of the electrical contacts can slide into a contact clip of the electrically conductive terminal. The electrically conductive terminal includes a latch mechanism. An electrical connection between the base portion and the extension portion is created when the electrical contacts are inserted into the contact clip and held by the latch mechanism. The long (Continued)

injector further comprises an overmolded body encapsulating the electrical connection between the base portion and the extension portion.

11 Claims, 4 Drawing Sheets

(58) Field of Classification Search
USPC ..... 123/468, 469, 470
See application file for complete search history.

(56) References Cited

U.S. PATENT DOCUMENTS

| | | | | |
|---|---|---|---|---|
| 5,598,824 | A | 2/1997 | Treusch et al. | 123/470 |
| 5,934,253 | A | 8/1999 | Kojima et al. | 123/470 |
| 7,213,578 | B2 | 5/2007 | Oguma | 123/470 |
| 8,707,772 | B2 | 4/2014 | Kondo et al. | 73/114.43 |
| 9,429,122 | B2 | 8/2016 | Akazaki et al. | |

FOREIGN PATENT DOCUMENTS

| | | | | |
|---|---|---|---|---|
| DE | 4131537 | A1 | 4/1993 | F02M 51/00 |
| EP | 1724880 | A1 | 11/2006 | H01R 13/42 |
| WO | 2017/108749 | A1 | 6/1917 | F02M 51/00 |
| WO | 91/11608 | A1 | 8/1991 | F02M 51/00 |

OTHER PUBLICATIONS

International Search Report and Written Opinion, Application No. PCT/EP2016/081858, 11 pages, dated Mar. 21, 2017.
Chinese Office Action, Application No. 201680075338.0, 20 pages, dated Nov. 18, 2019.

LONG INJECTOR FOR FUEL INJECTION INTO AN INTERNAL COMBUSTION ENGINE

CROSS-REFERENCE TO RELATED APPLICATIONS

This application is a U.S. National Stage Application of International Application No. PCT/EP2016/081858 filed Dec. 20, 2016, which designates the United States of America, and claims priority to EP Patent Application No. 15201777.8 filed Dec. 21, 2015, the contents of which are hereby incorporated by reference in their entirety.

TECHNICAL FIELD

The present disclosure relates to internal combustion engines. Various embodiments may include a long injector for fuel injection into an internal combustion engine, and in particular to an electrical connection between a base portion and an extension portion of a long injector, wherein the long injector is formed by connecting the extension portion to the base portion.

BACKGROUND

In common internal combustion engines, fuel injector systems are used to inject highly pressurized gasoline directly into combustion chambers of the internal combustion engines. An injector must be inserted deep into an internal combustion chamber of an internal combustion engine to improve the efficiency of the engine. Such a fuel injector in common internal combustion engines typically has a length of about 90 mm. Due to the restricted space in the cylindrical volume inside the cylinder block and densely arranged equipment around the cylinder head, which also limits the space available outside the cylinder block, long injectors have been designed by connecting an extension portion to such a common fuel injector. In particular, by connecting an extension portion to a common fuel injector, the length of the fuel injector can be extended from about 90 mm to a length ranging from about 150 mm to about 190 mm.

U.S. Pat. No. 7,213,578 B2 discloses a mounting structure for an injector for fuel injection into an internal combustion engine, wherein a fixing member is inserted into a hole of a cylinder head in an axial direction. Thus, the injector is fixed between the fixing member and the cylinder head. A connector portion of the fixing member is inserted into the hole of the cylinder head together with the fixing member, and the connector portion of the fixing member is connected to a connector portion of the injector. A first socket provided on an end of the connector portion of the fixing member opposite from the injector is disposed outside the cylinder head, wherein this socket is connected to a power source.

SUMMARY

The teachings of the present disclosure may provide an improved long injector, which can easily be inserted deeply into an internal combustion engine. For example, a long injector for fuel injection into an internal combustion engine, may include a base portion (2) and an extension portion (3). The extension portion (3) is electrically connected to the base portion (2). An end (4) of the extension portion (3) comprises an electrically conductive terminal (5) with one or more contact clips (6). The one or more contact clips (6) are spaced at a distance (7) from each other or from a side wall (8) of the electrically conductive terminal (5). An end (9) of the base portion (2) comprises one or more electrical contacts (10). Each of the one or more electrical contacts (10) is positioned at the end (9) of the base portion (2) in such a way, that each of the one or more electrical contacts (10) can slide into a respective contact clip (5) of the electrically conductive terminal (5) when connecting the extension portion (3) to the base portion (2). The electrically conductive terminal (5) has a latch mechanism (11). An electrical connection (12) between the base portion (2) and the extension portion (3) is created, when each of the one or more electrical contacts (10) is inserted into the respective contact clip (5) and held by the latch mechanism (11). In some embodiments, there is an overmolded encapsulation body (13) encapsulating the electrical connection (12) between the base portion (2) and the extension portion (3).

In some embodiments, the encapsulation body (13) fixes the base portion (2) to the extension portion (3) such that the base portion (2) and the extension portion (3) are not nondestructively separable from one another.

In some embodiments, the one or more contact clips (6) comprise an elastic material (14), and wherein the latch mechanism (11) is realized by the elastic material (14) of the one or more contact clips (6) in such a way, that the one or more electrical contacts (10) are compressed by the elastic material (14) of the one or more contact clips (6).

In some embodiments, the end (9) of the base portion (2) further comprises one or more ribs (15), that are positioned in such a way, that each rib (14) can be inserted into a distance (7) between two contact clips (6) of the extension portion (3) or a distance (7) between a contact clip (5) and a side wall (8) of the electrically conductive terminal (5).

Some embodiments may include a fuel injection system of an internal combustion engine, comprising a long injector (1) according to the above description.

In some embodiments, there is a fuel rail having an outlet port, wherein the long injector (1) is mechanically and hydraulically coupled to the outlet port in nondestructively separable fashion.

In some embodiments, there is a cylinder head of the internal combustion engine, wherein the electrical connection (12) is arranged in a bore of the cylinder head.

As another example, some embodiments may include a vehicle comprising a fuel injection system according to the above description.

As another example, some embodiments may include a method for electrically connecting a base portion to an extension portion to produce a long injector for fuel injection into an internal combustion engine, comprising the following: providing an extension portion, wherein an end of the extension portion comprises an electrically conductive terminal with one or more contact clips, wherein the one or more contact clips are spaced at a distance from each other or from a side wall of the electrically conductive terminal (21), providing a base portion, wherein an end of the base portion comprises one or more electrical contacts, wherein each of the one or more electrical contacts is positioned in such a way, that each of the one or more electrical contacts can slide into a respective contact clip of the electrically conductive terminal when connecting the extension portion to the base portion (22), electrically connecting the extension portion to the base portion, by inserting the one or more electrical contacts into the respective contact clip, until each of the one or more electrical contacts is held by a latch mechanism of the electrically conductive terminal (23), and overmolding the electrical connection (24) to produce an encapsulation body (13), encapsulating the electrical connection (12) between the base portion (2) and the extension portion (3).

In some embodiments, the electrical connection (24) is overmolded with a resin or a thermoplastic material to produce the encapsulation body (13).

In some embodiments, the one or more contact clips comprise an elastic material, and wherein the step of electrically connecting the extension portion to the base portion comprises compressing the one or more electric contacts by the elastic material of the one or more contact clips.

In some embodiments, the method further comprises the step of providing one or more ribs at the end of the base portion, which are positioned in such a way, that each of the one or more ribs can be inserted into a distance between two contact clips or a distance between a contact clip and a side wall of the electrically conductive terminal.

BRIEF DESCRIPTION OF THE DRAWINGS

Embodiments of the teachings herein will now be described with reference to the accompanying drawings.

DETAILED DESCRIPTION

Figure 1:
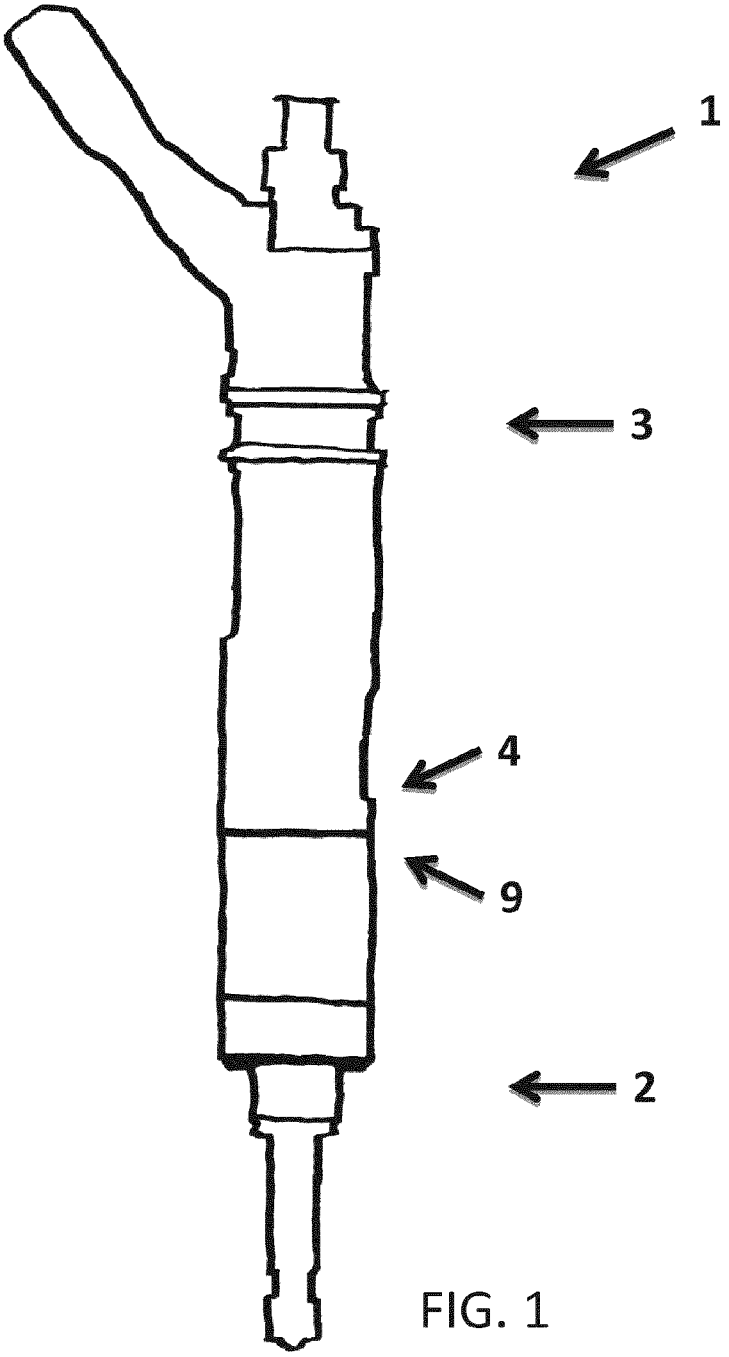
FIG. 1 illustrates a schematic drawing of a long injector for fuel injection into an internal combustion engine, according to embodiments of the present disclosure.

In some embodiments, a long injector for fuel injection into an internal combustion engine comprises a base portion and an extension portion. In the present context, a "long injector" is in particular understood to be an injector with a base portion and an extension portion, longitudinally extending the base portion.

The extension portion is electrically connected to the base portion, wherein an end of the extension portion comprises an electrically conductive terminal with one or more contact clips, wherein the one or more contact clips are spaced at a distance from each other or from a side wall of the electrically conductive terminal, wherein an end of the base portion comprises one or more electrical contacts, wherein each of the one or more electrical contacts is positioned at the end of the base portion in such a way, that each of the one or more electrical contacts can slide into a respective contact clip of the electrically conductive terminal when connecting the extension portion to the base portion, and wherein the electrically conductive terminal has a latch mechanism, wherein an electrical connection between the base portion and the extension portion is created, when each of the one or more electrical contacts is inserted into the respective contact clip and held by the latch mechanism.

Thereby, an improved long injector is provided, which can easily be inserted deeply into an internal combustion engine. In particular the one or more electrical contacts on the base portion and the respective contact clips on the electrically conductive terminal are located and orientated in such a way, that their outline, when they are connected to each other, lies within the cylindrical shape of the long injector. Thus, it can be ensured that the electrical connection between the base portion and the extension portion does not protrude out of the cylindrical shape of the long injector and the long injector can be inserted deeply into the cylindrical opening of the cylinder block of the engine. Therein the extension portion can be fixed onto the cylinder head and acts as a mechanical fixture of the base portion of the long injector. The latch mechanism of the electrical connection provides a mechanical stop during the assembly process of the extension portion to the base portion and stabilizes the assembly mechanically in such a way, that a stable electrical connection between the extension portion and the base portion is maintained.

In some embodiments, the long injector comprises an encapsulation body which encapsulates the electrical connection. The encapsulation body provides a one-body design of the long injector and mechanically protects the electrical connection, wherein additionally the electrical connection is protected against ingress of solid objects and liquids to prevent corrosion that could lead to a destruction of the electrical connection.

In some embodiments, the encapsulation body is an overmolded body. The overmolded encapsulation body in particular comprises or consists of a resin or a thermoplastic material. In some embodiments, the encapsulation body fixes the base portion to the extension portion such that the base portion and the extension portion are not nondestructively separable from one another. To put it differently, the base portion and the extension portion are non-detachably fixed to each other by means of the overmolded encapsulation body. In this way, the long injector can be handled as one piece during installation. With advantage, a particular precise positioning of the base portion to the extension portion is achievable.

In some embodiments, the one or more contact clips comprise an elastic material, wherein the latch mechanism is realized by the elastic material in such a way, that the one or more electric contacts are compressed by the elastic material of the one or more contact clips. Thus, the latch mechanism can be realized by the design of the contact clips, and thus by fewer components compared to a design, wherein the latch mechanism is realized by separate components within the electrically conductive terminal. Thereby material cost and process time of the assembly of the extension portion and the base portion can be reduced, whereby the overall costs of the long injector are reduced.

In some embodiments, the end of the base portion may comprise one or more ribs positioned in such a way that each of the one or more ribs can be inserted into a respective distance between two contact clips of the electrically conductive terminal or a respective distance between a contact clip and a side wall of the electrically conductive terminal. By the ribs the one or more contact clips can be stabilized during insertion of the electrical contacts and stably kept in the position, in which the electrical connection is created, and prevented from losing the electrical connection by expanding. This is also important during encapsulating the electrical connection, as the encapsulation material is injected with pressure and heat onto the electrical connection, in particular the electrical connection that is formed by the electrical contacts and the contact clips. In some embodiments, a fuel injection system of an internal combustion engine comprises a long injector as described above. The advantage of such a fuel injection system is that it comprises a long injector that can easily be inserted deeply into a combustion chamber of an internal combustion engine, wherein the extension portion is in particular fixed onto a cylinder head of the engine and acts as a mechanical fixture for the base portion of the injector.

In some embodiments, the long injector is shaped and configured such that the electrical connection is arrangeable inside a bore of the cylinder head of the engine. The electrical connection from the top of the extension portion to the base portion is preferably realized in such a way, that it does not protrude out of the cylindrical shape of the long injector.

In some embodiments, the fuel injection system also comprises a fuel rail having an outlet port. In some embodiments, the fuel rail may comprise an elongated tubular body comprising a plurality of outlet ports, each outlet port in particular being assigned to a respective cylinder of the combustion engine. The long injector may be hydraulically and mechanically coupled to the outlet port—in particular to one of the outlet ports—in nondestructively separable fashion. In some embodiments, the extension portion of the long injector is shifted into an injector cup which is fixed to the outlet port and may additionally be clamped or screwed to the injector cup in some embodiments.

In some embodiments, the fuel delivery assembly comprises the cylinder head of the internal combustion engine and the electrical connection of the long injector is arranged in a bore of the cylinder head. In this way, the same base portions and fuel rails can be used for engines with differently shape cylinder heads by using long injectors with different extension portions.

In some embodiments, a vehicle comprises a fuel injection system that comprises a long injector as described above. The advantage of such a vehicle is that the long injector can easily be inserted deeply into an internal combustion chamber of an internal combustion engine, wherein the extension portion is fixed onto the cylinder head and acts as a mechanical fixture for the base portion of the injector and wherein the electrical connection from the top of the extension portion to the base portion is realized in such a way, that it does not protrude out of the cylindrical shape of the long injector.

In some embodiments, a method for electrically connecting a base portion to an extension portion to produce a long injector for fuel injection into an internal combustion engine comprises the following: Providing an extension portion, wherein an end of the extension portion comprises an electrically conductive terminal with one or more contact clips, wherein the one or more contact clips are spaced at a distance from each other or from a side wall of the electrically conductive terminal, providing a base portion, wherein an end of the base portion comprises one or more electrical contacts, wherein each of the one or more electrical contacts is positioned at the end of the base portion in such a way, that each of the one or more electrical contacts can slide into a respective contact clip of the electrically conductive terminal when connecting the extension portion to the base portion, electrically connecting the extension portion to the base portion by inserting the one or more electrical contacts into the respective contact clips, until each of the one or more electrical contacts is held by a latch mechanism of the electrically conductive terminal. Thereby, a method for producing an improved long injector, which can easily be inserted deeply into an internal combustion engine, is provided. In particular, by providing an extension portion comprising an electrically conductive terminal which comprises one or more contact clips and a base portion comprising one or more electrical contacts wherein the one or more electrical contacts on the base portion and the respective contact clips on the electrically conductive terminal are located and orientated in such a way, that it can be ensured that the electrical connection between the base portion and the extension portion does not protrude out of the cylindrical shape of the long injector. Thus the long injector can be inserted deeply into the cylindrical opening of the cylinder block of the engine.

The method may further comprise encapsulating the electrical connection. By encapsulating the electrical connection an encapsulation body is provided, through which a one-body design of the long injector can be provided, which mechanically protects the electrical connection, wherein additionally the electrical connection is protected against ingress of solid objects and liquids to prevent corrosion that could lead to a destruction of the electrical connection. In some embodiments, the method comprises a step of overmolding the electrical connection—in particular with a resin or a thermoplastic material—to produce the encapsulation body which encapsulating the electrical connection between the base portion and the extension portion.

In some embodiments, the one or more contact clips may comprise an elastic material, wherein the step of electrically connecting the extension portion to the base portion comprises compressing the one or more electric contacts by the elastic material of the one or more contact clips. Thus, the latch mechanism can be realized by the design of the contact clips, and thus by fewer components compared to a design, wherein the latch mechanism is realized by separate components within the electrically conductive terminal. Thereby material cost and process time of the assembly of the extension portion and the base portion can be reduced, whereby the overall costs of the long injector are reduced.

In some embodiments, the method may further comprise providing one or more ribs on the end of the base portion that are positioned in such a way, that each of the one or more ribs can be inserted into a respective distance between two contact clips of the electrically conductive terminal or a respective distance between a contact clip and a side wall of the electrically conductive terminal. By the ribs the one or more contact clips can be stabilized during insertion of the electrical contacts and stably kept in the position in which the electrical connection is created and prevented from losing the electrical connection by expanding. This is also important during encapsulating the electrical connection, that may be an overmolding process with a resin or thermoplastic material, as the encapsulation material is injected with pressure and heat onto the electrical connection, in particular the electrical connection between the electrical contacts and the contact clips.

FIG. 1 illustrates a schematic drawing of a long injector 1 for fuel injection into an internal combustion engine, according to embodiments of the present disclosure. In common internal combustion engines, an injector for fuel injection must be inserted deep into the internal combustion chamber to improve the efficiency of the engines. Due to the restricted space inside the cylinder block and the densely arranged equipment around the cylinder head, which limits the space available outside the cylinder block, long injectors have been developed to insert the injector deeply into the cylinder head of internal combustion chambers. In particular by adding an extension portion to a base portion of an injector a long injector with a length in the range of about 150 mm to about 190 mm is provided.

According to the embodiments shown in FIG. 1, the long injector 1 comprises a base portion 2 and an extension portion 3, wherein an end 9 of the base portion 2 is connected mechanically and electrically to an end 4 of the extension portion 3. An electrical connection 12 is realized from the end 9 of the base portion 2 to the top of the extension portion 3, where an external power source can be connected to the injector with a connector device by using a standard plug connector.

Figure 2A:
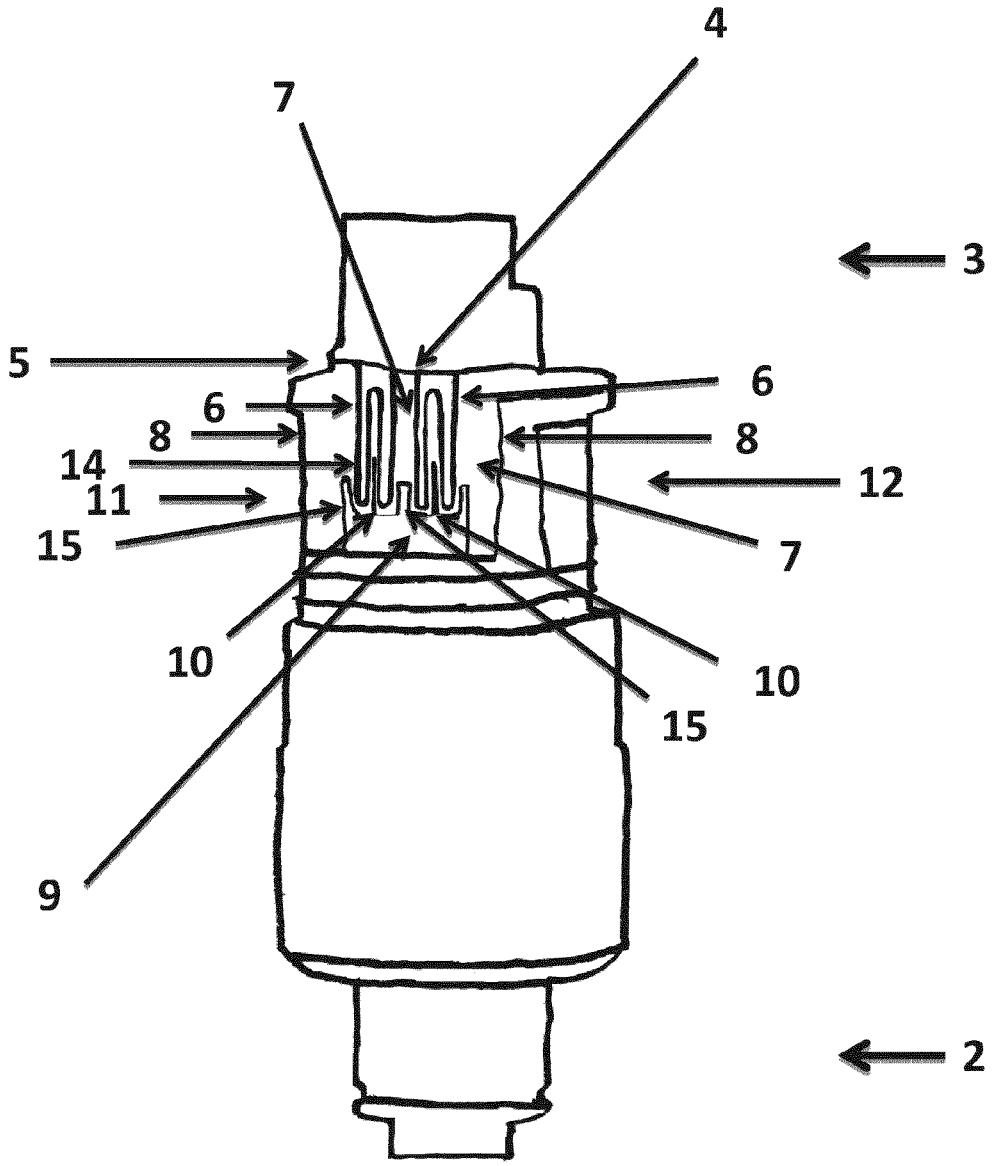
FIG. 2*a* illustrates a schematic drawing of the electrical connection between the extension portion and the base portion of a long injector before encapsulating the electrical connection, according to embodiments of the present disclosure.

FIG. 2*a* illustrates a schematic drawing of the electrical connection 12 between the extension portion 3 and the base portion of a long injector 1 before encapsulating the electrical connection, according to embodiments of the present disclosure. As shown in FIG. 2*a*, the base portion 2 comprises an end 9 facing to the extension portion 3 of the long injector 1, on which two electrical contacts 10 are provided. The extension portion 3 comprises an end 4 facing the base portion 2, on which an electrically conductive terminal 5 with two contact clips 6 is provided. The contact clips 6 are spaced at a distance 7 from each other and from a side wall 8 of the electrically conductive terminal 5, and thus, the contact clips 6 are provided in a fork design. Therein the contact clips 6 are positioned and orientated in such a way, that they do not protrude out of the cylindrical shape of the injector.

Furthermore, the two electrical contacts 10 are positioned relative to the respective contact clips 6 in such a way, that each of two electrical contacts 10 can slide into a respective contact clip 5 of the electrically conductive terminal 5 when connecting the extension portion 3 to the base portion 2. Further, the electronically conductive terminal 5 of the extension portion 3 has a latch mechanism 11. Therein, an electrical connection 12 is created, when each of the two electrical contacts 10 is inserted into the respective contact clip 5 and held by the latch mechanism 11.

Thus, the electrical connection between the base portion and the extension portion does not protrude out of the cylindrical shape of the long injector and the long injector can be inserted deeply into the cylindrical opening of the cylinder block of the engine and thus, an improved long injector is provided, which can easily be inserted deeply into an internal combustion engine.

According to the embodiment shown in FIG. 2*a*, the two contact clips 6 comprise an elastic material 14, wherein the latch mechanism 11 is realized by the elastic material 14 of the contact clips 6 in such a way, that the two electric contacts 10 are compressed by the elastic material 14 of the two contact clips 6. However, that the latch mechanism 11 is realized by the elastic material 14 of the contact clips 6 should merely be understood as an example, and the latch mechanism 11 can also be realized by a plurality of other components, for example by a mechanical latch mechanism.

The end 9 of the base portion 2 further comprises three ribs 15 that are positioned in such a way, that each rib 14 can be inserted into a distance 7 between two contact clips 6 of the extension portion 3 or a distance 7 between a contact clip 6 and a side wall 8 of the electrically conductive terminal 5. Therein the ribs can be formed by plastic material within the base portion 2.

Figure 2B:
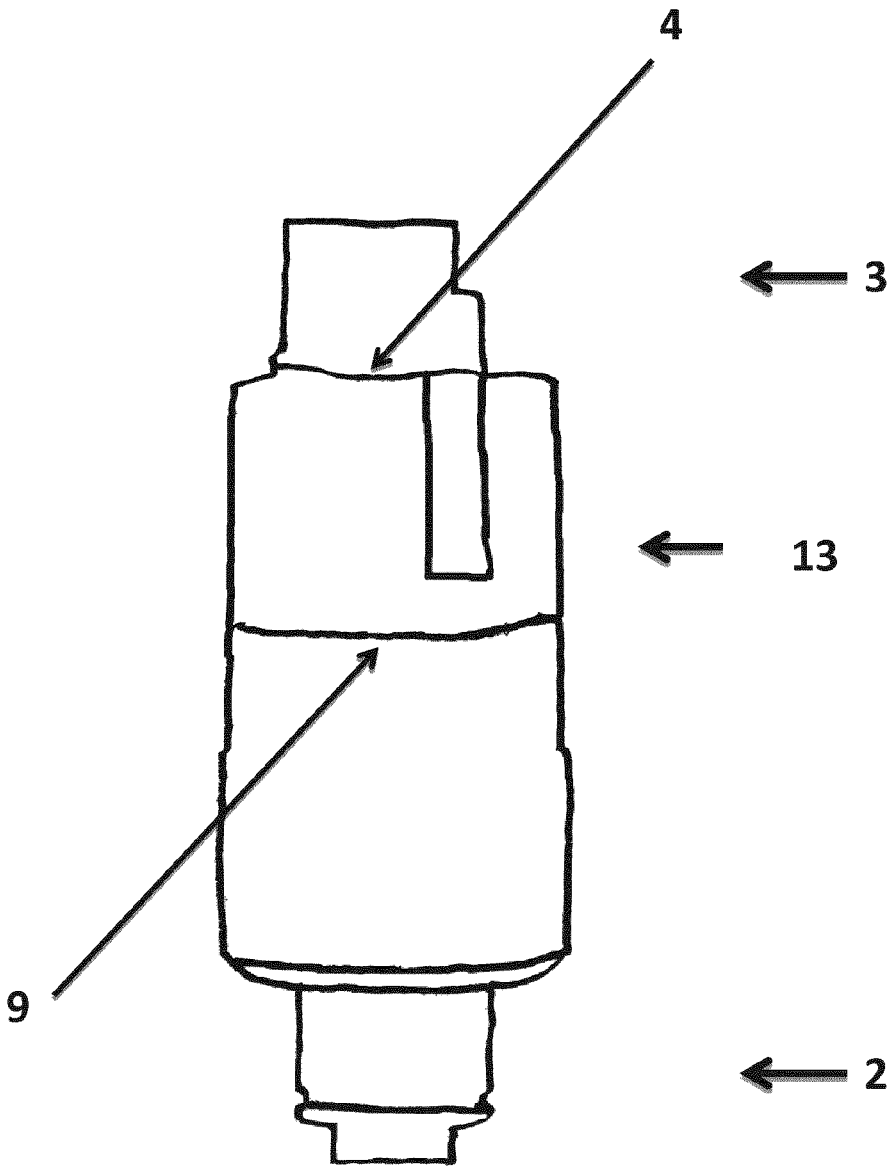
FIG. 2*b* illustrates a schematic drawing of the electrical connection between the extension portion and the base portion of a long injector after encapsulating the electrical connection, according to embodiments of the present disclosure.

FIG. 2*b* illustrates a schematic drawing of the electrical connection 12 between the extension portion 3 and the base portion of a long injector 1 after encapsulating the electrical connection, according to embodiments of the present disclosure.

As shown in FIG. 2*b*, the encapsulation body 13 formed by encapsulating of the electrical connection encloses the end 9 of the base portion 2 that is attached to the end 4 of extension portion 3 by the electrical connection 12, wherein the body can consist of a resin material or a thermo-plastic material used in an overmolding process. The design realizes a single body for the injector, wherein both portions are mechanically connected in a stable way by the encapsulation body 13 that can only be dismantled with destruction.

Figure 3:
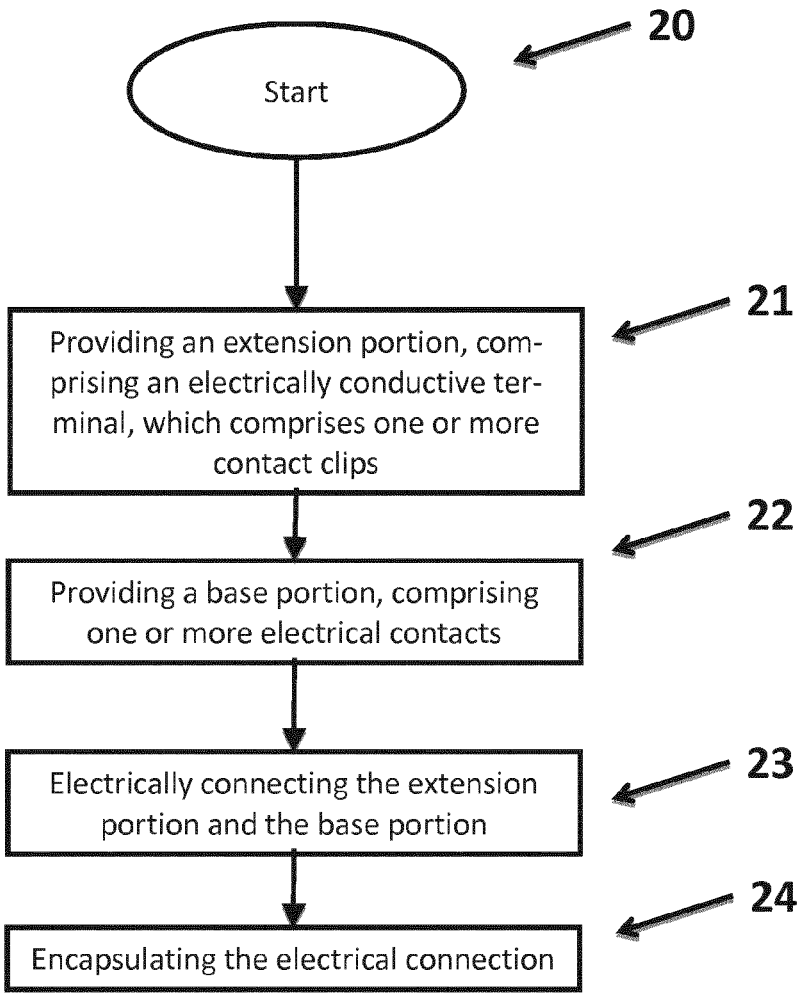
FIG. 3 is a flow chart illustrating a method for electrically connecting a base portion to an extension portion to produce a long injector for fuel injection into an internal combustion engine, according to embodiments of the present disclosure.

FIG. 3 is a flow chart illustrating a method for electrically connecting a base portion 2 to an extension portion 3 to produce a long injector 1 for fuel injection into an internal combustion engine, according to embodiments of the present disclosure.

According to FIG. 3, the process starts with step 20. In step 21 an extension portion is provided, wherein an end of the extension portion comprises an electrically conductive terminal with one or more contact clips, wherein the one or more contact clips are spaced at a distance from each other or from a side wall of the electrically conductive terminal.

In step 22 a base portion is provided, wherein an end of the base portion comprises one or more electrical contacts, wherein each of the one or more electrical contacts is positioned in such a way, that each of the one or more electrical contacts can slide into a respective contact clip of the extension terminal when connecting the extension portion to the base portion.

In step 23 the extension portion is electrically connected to the base portion, by inserting the one or more electrical contacts into the respective contact clip until each of the one or more electrical contacts is held by a latch mechanism of the electronically conductive terminal. Thus, the electrical connection is created, when each of the one or more electrical contacts is inserted into the respective contact clip and held by the latch mechanism.

Further, the method shown in FIG. 3 comprises the additional step of encapsulating the electrical connection with an encapsulation body. Encapsulating the electrical connection can be an overmolding process with a resin or thermo-plastic material.

What is claimed is:

1. A long injector for fuel injection into an internal combustion engine, the long injector comprising:

a base portion; and an extension portion electrically connected to the base portion; and an encapsulation body molded over the base portion and the extension portion, wherein the base portion and the extension portion cannot be separated without destroying the encapsulation body;

wherein a first end of the extension portion comprises an electrically conductive terminal with one or more contact clips;

the one or more contact clips are spaced at a distance from each other or from a side wall of the electrically conductive terminal;

a first end of the base portion comprises one or more electrical contacts positioned at the first end of the base portion in such a way that each of the one or more electrical contacts can slide into a respective contact clip of the electrically conductive terminal when connecting the extension portion to the base portion;

the electrically conductive terminal includes a latch mechanism;

an electrical connection between the base portion and the extension portion is created when each of the one or more electrical contacts is inserted into the respective contact clip and held by the latch mechanism.

2. A long injector according to claim 1, wherein the one or more contact clips comprise an elastic material; and the one or more electrical contacts are compressed by the elastic material of the one or more contact clips.

3. A long injector according to claim 1, wherein the first end of the base portion further comprises one or more ribs positioned in such a way that each rib can be inserted into a distance between two contact clips of the extension portion or a distance between a contact clip and a side wall of the electrically conductive terminal.

4. A fuel injection system of an internal combustion engine, the system comprising:

a combustion chamber; and a long injector dosing fuel into the combustion chamber;

wherein the long injector comprises:

a base portion;

an extension portion electrically connected to the base portion; and an encapsulation body molded over the base portion and the extension portion, wherein the base portion and the extension portion cannot be separated without destroying the encapsulation body;

wherein a first end of the extension portion comprises an electrically conductive terminal with one or more contact clips;

the one or more contact clips are spaced at a distance from each other or from a side wall of the electrically conductive terminal;

a first end of the base portion comprises one or more electrical contacts positioned at the first end of the base portion in such a way that each of the one or more electrical contacts can slide into a respective contact clip of the electrically conductive terminal when connecting the extension portion to the base portion;

the electrically conductive terminal includes a latch mechanism;

an electrical connection between the base portion and the extension portion is created when each of the one or more electrical contacts is inserted into the respective contact clip and held by the latch mechanism.

5. A fuel injection system according to claim 4, further comprising a fuel rail having an outlet port;

wherein the long injector is mechanically and hydraulically coupled to the outlet port in nondestructively separable fashion.

6. A fuel injection system according to claim 4, wherein the combustion chamber is arranged in a cylinder head and the electrical connection is arranged in a bore of the cylinder head.

7. A vehicle comprising:

a combustion chamber;

a drive mechanism driven by combustion of fuel in the combustion chamber; and a long injector dosing fuel into the combustion chamber;

wherein the long injector comprises:

a base portion;

an extension portion electrically connected to the base portion; and an encapsulation body molded over the base portion and the extension portion, wherein the base portion and the extension portion cannot be separated without destroying the encapsulation body;

wherein a first end of the extension portion comprises an electrically conductive terminal with one or more contact clips;

the one or more contact clips are spaced at a distance from each other or from a side wall of the electrically conductive terminal;

a first end of the base portion comprises one or more electrical contacts positioned at the first end of the base portion in such a way that each of the one or more electrical contacts can slide into a respective contact clip of the electrically conductive terminal when connecting the extension portion to the base portion;

the electrically conductive terminal includes a latch mechanism;

an electrical connection between the base portion and the extension portion is created when each of the one or more electrical contacts is inserted into the respective contact clip and held by the latch mechanism.

8. A method for manufacturing a long injector for fuel injection into an internal combustion engine, the method comprising:

providing an extension portion, wherein an end of the extension portion comprises an electrically conductive terminal with one or more contact clips, wherein the one or more contact clips are spaced at a distance from each other or from a side wall of the electrically conductive terminal;

providing a base portion, wherein an end of the base portion comprises one or more electrical contacts, wherein each of the one or more electrical contacts is positioned in such a way, that each of the one or more electrical contacts can slide into a respective contact clip of the electrically conductive terminal when connecting the extension portion to the base portion;

electrically connecting the extension portion to the base portion by inserting the one or more electrical contacts into the respective contact clip until each of the one or more electrical contacts is held by a latch mechanism of the electrically conductive terminal; and overmolding the electrical connection to produce an encapsulation body encapsulating the electrical connection between the base portion and the extension portion, wherein the base portion and the extension portion cannot be separated without destroying the encapsulation body.

9. A method according to claim 8, wherein the electrical connection is overmolded with a resin or a thermoplastic material to produce the encapsulation body.

10. A method according to claim 8, wherein the one or more contact clips comprise an elastic material; and electrically connecting the extension portion to the base portion comprises compressing the one or more electric contacts by the elastic material of the one or more contact clips.

11. A method according to claim 8, further comprising providing one or more ribs at the end of the base portion, which are positioned in such a way, that each of the one or more ribs can be inserted into a distance between two contact clips or a distance between a contact clip and a side wall of the electrically conductive terminal.

* * * * *